US010641122B2

(12) United States Patent
Lewis

(10) Patent No.: US 10,641,122 B2
(45) **Date of Patent: *May 5, 2020**

(54) TIP CLEARANCE CONTROL FOR TURBINE BLADES

(71) Applicant: ROLLS-ROYCE plc, London (GB)

(72) Inventor: Leo V. Lewis, Kenilworth (GB)

(73) Assignee: ROLLS-ROYCE PLC, London (GB)

( * ) Notice: Subject to any disclaimer, the term of this patent is extended or adjusted under 35 U.S.C. 154(b) by 151 days.

This patent is subject to a terminal disclaimer.

(21) Appl. No.: 16/055,466

(22) Filed: Aug. 6, 2018

(65) Prior Publication Data

US 2018/0340442 A1 Nov. 29, 2018

Related U.S. Application Data

(63) Continuation of application No. 14/967,997, filed on Dec. 14, 2015, now Pat. No. 10,208,617.

(30) Foreign Application Priority Data

Dec. 16, 2014 (GB) ..... 1422359.8

(51) Int. Cl.
*F01D 11/24* (2006.01)
*F01D 5/02* (2006.01)
(Continued)

(52) U.S. Cl.
CPC ..... *F01D 11/24* (2013.01); *F01D 5/02* (2013.01); *F01D 5/12* (2013.01); *F01D 25/10* (2013.01);
(Continued)

(58) Field of Classification Search
CPC ..... F01D 1/24; F01D 1/18; F01D 1/20; F01D 25/12; F01D 25/24; F05D 2260/201
See application file for complete search history.

(56) References Cited

U.S. PATENT DOCUMENTS 5,601,402 A 2/1997 Wakeman et al.
7,740,444 B2 6/2010 Lee et al.
(Continued)

FOREIGN PATENT DOCUMENTS

EP 1 566 524 A2 8/2005
EP 2 372 105 A2 10/2011
(Continued)

OTHER PUBLICATIONS

U.S. Appl. No. 14/967,997, filed Dec. 14, 2015 in the name of Jones.
(Continued)

*Primary Examiner* — Richard A Edgar
*Assistant Examiner* — Maxime M Adjagbe
(74) *Attorney, Agent, or Firm* — Oliff PLC

(57) ABSTRACT

An arrangement for a gas turbine engine that includes a turbine blade configured to rotate about an axis, a casing radially outside of the turbine blade, and a carrier segment mounted to the casing so as to define a first impingement space therebetween. The carrier segment is positioned radially outside the turbine blade and includes a first impingement carrier wall, a main carrier wall, and a cooling chamber. The first impingement carrier wall is adjacent to and radially inside of the first impingement space, and the first impingement carrier wall includes a first aperture. The main carrier wall is radially inside of the first impingement carrier wall. The cooling chamber is radially inside of the main carrier wall. Additionally, an intermediate chamber is disposed radially between the cooling chamber and the first impingement space. A second aperture is configured to allow ingress of air into the intermediate chamber.

12 Claims, 7 Drawing Sheets

(51) Int. Cl.

| | |
|---|---|
| ***F01D 5/12*** | (2006.01) |
| ***F01D 25/24*** | (2006.01) |
| ***F01D 25/10*** | (2006.01) |
| ***F01D 25/12*** | (2006.01) |

(52) U.S. Cl.
CPC ..... *F01D 25/12* (2013.01); *F01D 25/24* (2013.01); *F05D 2220/32* (2013.01); *F05D 2260/201* (2013.01)

(56) References Cited

U.S. PATENT DOCUMENTS

| | | | | |
|---|---|---|---|---|
| 2011/0229306 | A1 | 9/2011 | Lewis et al. | |
| 2013/0017060 | A1* | 1/2013 | Boswell ..... | F01D 11/24 415/1 |
| 2014/0341717 | A1 | 11/2014 | Jones et al. | |

FOREIGN PATENT DOCUMENTS

| | | |
|---|---|---|
| EP | 2 546 471 A2 | 1/2013 |
| GB | 2 025 537 A | 1/1980 |

OTHER PUBLICATIONS

U.S. Appl. No. 14/967,875, filed Dec. 14, 2015 in the name of Jones.
Jun. 4, 2015 Search Report issued in British Patent Application No. 1422359.8.
Jun. 4, 2015 Search Report issued in British Patent Application No. 1422360.6.
Apr. 29, 2016 Search Report issued in European Patent Application No. 15199466.
Apr. 29, 2016 Search Report issued in European Patent Application No. 15199465.
Oct. 4, 2017 Office Action issued in U.S. Appl. No. 14/967,997.
Feb. 7, 2018 Office Action Issued in U.S. Appl. No. 14/967,875.
Mar. 26, 2018 Office Action Issued in U.S. Appl. No. 14/967,997.
Aug. 8, 2018 Office Action issued in U.S. Appl. No. 14/967,997.

* cited by examiner

TIP CLEARANCE CONTROL FOR TURBINE BLADES

TECHNICAL FIELD

This invention relates to the control of tip clearance of rotating blades within a gas turbine engine by controlling the temperature of the turbine casing. More particularly it relates to novel carriers, and carrier segments for forming such carriers, for carrying the turbine blade track liner segments, and also to methods of controlling the temperature of the turbine casing using arrangements comprising the carriers.

BACKGROUND OF THE INVENTION AND PRIOR ART

FIG. 1 of the accompanying drawings is a schematic representation of a known aircraft ducted fan gas turbine engine 10 comprising, in axial flow series: an air intake 12, a propulsive fan 14 having a plurality of fan blades 16, an intermediate pressure compressor 18, a high-pressure compressor 20, a combustor 22, a high-pressure turbine 24, an intermediate pressure turbine 26, a low-pressure turbine 28 and a core exhaust nozzle 30. A nacelle 32 generally surrounds the engine 10 and defines the intake 12, a bypass duct 34 and a bypass exhaust nozzle 36. Electrical power for the aero engine and aircraft systems is generated by a wound field synchronous generator 38. The generator 38 is driven via a mechanical drive train 40 which includes an angle drive shaft 42, a step-aside gearbox 44 and a radial drive 46 which is coupled to the high pressure compressor 34 via a geared arrangement.

Air entering the intake 12 is accelerated by the fan 14 to produce a bypass flow and a core flow. The bypass flow travels down the bypass duct 34 and exits the bypass exhaust nozzle 36 to provide the majority of the propulsive thrust produced by the engine 10. However, a proportion of the bypass flow is taken off and fed internally to various downstream (hot) portions of the engine to provide a flow of relatively cool air at locations or to components as or where necessary. The core flow enters, in axial flow series, the intermediate pressure compressor 18, high pressure compressor 20 and the combustor 22, where fuel is added to the compressed air and the mixture burnt. The hot combustion gas products expand through and drive the sequential high 24, intermediate 26, and low-pressure 28 turbines before being exhausted through the nozzle 30 to provide additional propulsive thrust. The high, intermediate and low-pressure turbines 24, 26, 28 respectively drive the high and intermediate pressure compressors 20, 18 and the fan 14 by interconnecting shafts 38, 40, 42.

In each of the turbine sections 24, 26, 28 the distance between the tips of the turbine blades and the radially inner surface of the turbine casing (or, more usually, the radially inner surface of the turbine blade track liner segments carried radially inwardly of, or forming part of, the casing) is known as the tip clearance. It is desirable for the tips of the turbine blades to rotate as close as possible to the engine casing without rubbing (or re-rubbing, in instances where it may be desirable to permit an initial or temporary degree of rubbing), because as the tip clearance increases, a portion of the expanded gas flow will pass through the tip clearance gap, and as a result the efficiency of the turbine decreases. This is known as over-tip leakage. The efficiency of the turbine, which partially depends upon tip clearance, directly affects the specific fuel consumption (SFC) of the engine. Accordingly, as tip clearance increases, SFC also rises, which is disadvantageous.

Under conditions of transient increases in engine power, such as during take-off or a step climb of an aircraft, as the disc and the blades of the turbine rotate, centrifugal force and increasing thermal loads cause the disc and blades to expand in a radial direction. The turbine casing also expands as it heats up, but typically there is a mismatch in radial expansion between the disc/blades and the casing. Specifically, the blades will normally expand radially more quickly than the casing, thereby reducing the blade tip clearance and potentially leading to rubbing (or re-rubbing) as the tips of blades come into contact with the interior of the casing, until the casing itself heats up and expands sufficiently to increase the tip clearance again back to an optimum distance. To accommodate such behavior, working tip clearances may thus need to be over-compensated for, leading to tip clearances under stable engine power conditions being greater than optimum for a major part of any flight profile or cycle.

In an effort to alleviate such a disadvantage, there have been several proposals in recent years which involve actively controlling the temperature of the turbine casing to a desired degree as or when required, so that the radial expansion of the casing can be more accurately matched in a responsive manner to that of the turbine disc/blades at any point or stage in a flight cycle, even under conditions of especially enhanced engine power such as a step climb.

One such known system is that disclosed in EP2372105A, which is shown schematically for a typical HP turbine architecture, by way of example, in FIG. 2 of the accompanying drawings. Here the proposed system allows a typical additional blade tip running gap associated with step climbs, being an excess over the optimum tip clearance gap G, to be removed, by ensuring that the casing can be thermally expanded very quickly in the event of a step climb. For this purpose a discrete, thin impingement plate 50 formed with any suitable pattern of impingement through-holes 52 therein is located radially within the casing 60 above (i.e. radially outwardly of) the carrier 70 and blade track liner segment 80 carried thereon. The principle is that in the event of a step climb, a valve 90 above (i.e. radially outwardly of) the casing 60 is opened, and heating air is drawn through the impingement holes 52 in the impingement plate 50 to heat and therefore thermally expand the casing 60 in a short space of time. It should be noted that before the valve 90 opens, the casing 60 is typically cooler than the heating air on account of the external cooling from the outboard bypass air. In this manner a more responsive arrangement for heating (and cooling, if required) the turbine casing to control the tip clearance of the rotating turbine blades at any given stage of a flight profile, e.g. even upon a step climb, is provided. This makes it possible to maintain a minimal tip clearance whilst preventing rubbing (or re-rubbing) of the blades against the turbine casing during transient increases in engine power, while maintaining a relatively high level of engine efficiency during stable cruise conditions.

In practical forms this known system shown in FIG. 2 typically employs a thin tinware sheet as the discrete impingement plate 50, which is not only very difficult to assemble, but also leads to significant problems in terms of air sealing and position control, since thin continuous sheet material typically has a much quicker thermal reaction time than the engine casing material itself, which may lead to buckling and thus making the impingement distance between it and the casing much harder to control for optimum impingement performance. Leakage around the impingement plate 50, leading to compromised engine efficiency, may also be a practical problem.

Another, similar, known system for actively controlling the temperature of the turbine casing is that disclosed in EP2546471A. In this system a dedicated inboard duct is provided, adjacent an inboard surface of the turbine casing, which has an outboard facing wall with a plurality of impingement holes formed therein and opening towards the inboard surface of the casing, through which impingement holes temperature control fluid can pass from within the inboard duct to impinge upon the inboard surface of the casing to regulate its temperature. The temperature control fluid, e.g. air from a compressor stage of the engine or even air taken from two or more locations at different temperatures so as to be mixed to a desired optimum temperature, may be re-circulated internally.

A disadvantage of this known system, however, is that the dedicated inboard duct is constituted by an additional component that adds weight, cost and build complexity to the overall arrangement. It also means that the recirculating temperature control air is applied to the casing substantially continuously, thereby requiring substantially constant temperature control regardless of whether a specific casing temperature requirement, e.g. heating during a step climb, is actually required in any given stage of an overall flight profile.

It is therefore an object of the present invention to provide a constructionally simpler, cheaper and more efficient system for actively controlling the temperature of the turbine casing of a gas turbine engine, especially for improving the responsiveness of an arrangement for heating and/or cooling a turbine casing to more efficiently control turbine blade tip clearance during transient increases in engine power during a flight profile, e.g. during step climbs.

SUMMARY OF THE INVENTION

The present invention provides a carrier segment as defined in the appended claims.

Described below is a carrier segment of a carrier section for circumscribing an array of circumferentially spaced turbine blades of a gas turbine engine, the blades being disposed radially inwardly of a turbine casing, the carrier segment including a carrier wall disposed radially inwardly of the casing and radially outwardly of the turbine blades, and the carrier wall comprising one or more portions facing the casing, wherein at least one of the one or more portions of the carrier wall is provided with one or more impingement apertures therein for passage therethrough of air of a predetermined temperature from a feed source into impingement onto the turbine casing.

Also described below is a carrier section for circumscribing an array of circumferentially spaced turbine blades of a gas turbine engine, the blades being disposed radially inwardly of a turbine casing, wherein the carrier section comprises a plurality of carrier segments according to the first aspect of the invention or any embodiment thereof.

In practical embodiments of the carrier section, pairs of like carrier segments may be attachable together at their respectively opposite circumferential ends in order to build up a complete annular carrier section or ring from a plurality of like carrier segments. Any suitable manner and means of attachment of adjacent carrier segments may be employed for this purpose, examples of which are well known and widely used in the art.

A gas turbine engine may comprise one of the described carrier sections.

A method of controlling the temperature of a turbine casing of a gas turbine engine is described below. The engine including an array of circumferentially spaced turbine blades disposed radially inwardly of the casing and circumscribed by a carrier section comprising a plurality of carrier segments according to the first aspect of the invention or any embodiment thereof, wherein the method comprises: arranging the carrier segments radially inwardly of the turbine casing and radially outwardly of the turbine blades, with the said one or more portions of their respective carrier walls facing the turbine casing, and passing air of a predetermined temperature from a feed source through the impingement apertures in the one or more portions of the carrier wall of the or each carrier segment and into impingement on the casing, so that the temperature of the casing is controlled in dependence on the predetermined temperature of the impinging airflow thereon.

The method of operating a gas turbine engine may, comprise: running the engine under at least one transient operating condition of increased power, and during said at least one transient operating condition feeding air of a predetermined temperature from a feed source through the impingement apertures in the one or more portions of the carrier wall of the or each carrier segment and into impingement on the turbine casing, so as to control the temperature of the casing in dependence on the predetermined temperature of the impinging airflow thereon.

As used herein, the term "turbine casing" is to be construed broadly as encompassing not only the engine outer casing itself in any turbine section of the engine, but any radially outwardly located (relative to the turbine blades and carrier segments) static part of the engine construction. Furthermore the term is to be understood as including within its meaning the radially inner surfaces of turbine blade track liner segments carried radially inwardly of, or forming part of, the casing proper.

In many embodiments the predetermined temperature of the air passed through the impingement apertures into impingement on the casing is such that the casing is heated thereby. Such heating may be during at least part of the transient operating condition of the engine under which it is run at increased power, which latter term means at increased power relative to the power generated by the engine in a stable operating condition other than when in said transient operating condition. Such a transient operating condition may for example be during a step climb, or take-off or other temporary stage of a flight profile/cycle in which the engine is accelerated or otherwise run at enhanced power.

In embodiments the predetermined temperature of the air fed to the impingement apertures may be any suitable temperature such that a desired or optimum level of heating or other temperature control of the casing is effected when the air impinges on it. Accordingly the feed source for the air may be from any suitable one or more sections of the engine. Thus, the air of a predetermined temperature which passes through the impingement aperture(s) and onto the turbine casing may optionally be defined in terms of also being of a predetermined pressure. In some embodiments the air feed source may be provided by substantially a single section of the engine, e.g. a compressor stage in the case of the invention being applied to the casing of a HP turbine section of the engine. However, in other embodiments the feed source may be provided by a combination of two or more different sections of the engine, optionally two or more sections supplying air at different temperatures, in order to provide a mixed or combination air feed source to supply air of a desired intermediate predefined temperature.

If desired or necessary, in embodiments where the air feed source is a combination source using air derived from two distinct locations within the engine, the arrangement may further comprise a control device, optionally in conjunction with one or more respective temperature sensing devices, configured and operable to control the overall temperature of the air fed to the impingement apertures in accordance with a predetermined temperature requirement dependent on the degree of heating or temperature regulation required by the turbine casing onto which the airflow impinges.

In some embodiments of the invention the carrier wall, whose one or more casing-facing portions have the one or more impingement apertures formed therein, may be an integral wall of the carrier segment, i.e. a wall thereof formed integrally with the remainder of the carrier segment during a method of its manufacture. Such a method may be a casting method, as is already widely used in the art, although other manufacturing methods, e.g. powder bed additive layer manufacturing methods, may also be employed. Thus, in current preferred embodiments the basic, unapertured carrier wall may already be inherently present in the structure of the carrier segment, leaving it just needing drilling or machining in a post-production step to form the required impingement apertures therein. Thus, once the carrier wall has been integrally formed as part of the carrier segment and had its apertures formed therein, no separate component is required to be inserted into, or used in combination with, the carrier segment to provide the carrier wall with its impingement aperture(s) via which the temperature-controlling air is fed onto the casing.

Generally, in various embodiments of the invention the carrier wall, or the one or more portions thereof, containing the impingement aperture(s) may be spaced from the turbine casing by any suitable distance. For example, the manner and/or location in which the carrier segment is mounted in the engine may be selected to define an appropriate or optimum impingement distance between the exits of the aperture(s) and the impingement surface of the casing, for example in order to provide an optimum impinging flow rate and/or flow volume of air onto the casing to deliver an optimum temperature controlling effect or responsiveness thereto.

In some embodiments it may be desirable to select the impingement distance (z) and/or the diameter (d) of a given impingement aperture such that the ratio z/d is within a desired or optimum range. For example, suitable preferred ratios z/d may be in the range of from about 1 to about 10, or from about 2 to about 6, e.g. around 4. In cases where, for example because of local variations in the relative configuration or mutual spacing of the carrier wall and/or the casing, a localised spacing between an exit of a given aperture and the relevant impingement surface of the casing may vary a small amount as between different apertures, by appropriate adjustment of the relevant diameter of that given aperture to preserve a desired or optimum z/d ratio, a uniform level of heating effect of the air being delivered to the casing via that aperture, as compared with other apertures, may be preserved.

As an alternative way of adjusting the above z/d ratio for impingement apertures all of a given diameter, it may be possible instead (or additionally) to form one or more of the apertures in a localised area or region of the carrier wall which has an enlarged thickness, e.g. in the form of a noggin or spigot, through which the aperture passes. Such a noggin or spigot may for example protrude into the gap between the relevant area or region of the carrier wall and the casing.

Nevertheless, in many preferred embodiments at least the portion(s) of the carrier wall having the impingement aperture(s) formed therein may be configured so as to be substantially parallel to the turbine casing against which the air passing therethrough is to impinge.

In embodiments of the invention the or each of the one or more portions of the carrier wall may each have one or more impingement apertures formed therein. In some preferred forms the or each of the one or more portions of the carrier wall may each have a plurality of impingement apertures formed therein. The apertures may be arranged symmetrically or asymmetrically, optionally generally so as to tailor the delivery of impinging air onto the casing at any desired one or more locations and/or areas thereon to effect optimum temperature control thereof.

In various embodiments of the invention the impingement aperture(s) may conveniently be formed in the carrier wall, or portion thereof, e.g. by drilling or machining in a post-production step, in a post-casting step in cases where a casting method is used to make the carrier segment. Alternatively the impingement aperture(s) may be formed during or as part of the overall process of forming the inherent wall structures of the carrier segment, especially in cases where a manufacturing method other than casting is employed.

In various embodiments the impingement aperture(s), which may be e.g. circular in cross-section (or alternatively any other suitable cross-sectional shape), may each be formed with its longitudinal axis substantially perpendicular or normal to the turbine casing, in order to optimise the temperature controlling effect of the air impinging thereon. However, in other embodiments it may be possible for the impingement aperture(s) (or at least one or more thereof) to be oriented each with its longitudinal axis non-perpendicular to the casing.

In various embodiments of the invention the impingement apertures may be provided in the one or more portions of the carrier wall in any suitable or appropriate number and/or relative spacing and/or area density and/or size (i.e. cross-sectional width or area), for example depending on the total cumulative flow of air desired to be delivered onto the casing for exerting an optimum temperature controlling effect or responsiveness thereon.

In some embodiments of the invention the carrier wall having the one or more portions provided with the impingement aperture(s) therein may be a carrier wall extending between front and rear carrier ends and having a circumferential profile, wherein the circumferential profile of the carrier wall is undulating. The carrier wall may optionally have a substantially uniform cross-sectional thickness.

A carrier wall of such an undulating shape may serve not only to give the carrier wall a desirable relatively high degree of strength, stiffness, and resistance against deforming, twisting or bending, but also may provide a ready and more efficient access route via one or more conduits passing through a carrier front wall to a cooling chamber located radially inwardly of the carrier wall, which may be arranged to have fed therein air of a desired temperature from an outboard and/or inboard air feed source for other temperature control (especially cooling) purposes in the overall turbine section arrangement.

In practical forms of such embodiments in which the carrier wall is undulating in circumferential profile, the carrier wall may have radially outer and inner faces, at least the radially inner one of which have an undulating surface profile defined by a mathematical wave function, e.g. a waveform having a regular repeating wave having a constant or a regularly varying wavelength and/or amplitude. By way of example, the wave function may define a relatively simple shape such as a part-cylindrical, part-polygonal, part-spherical, part-parabolic or part-hyperbolic curve. Alternatively, the wave function may define a more complex shape derived from any combination of two or more of any of the aforesaid curves, shapes or mathematical functions. Other mathematical functions defining the waveform(s) may also be possible.

In some such forms of such embodiments, each of the faces of the carrier wall may be substantially continuous traversing longitudinally between the front and rear carrier ends. In one form, the carrier wall may have an undulating wave profile which is substantially identical in any given circumferential direction at any longitudinal location between the said front and rear carrier ends. In this manner the one more peak regions of the undulations may conveniently provide one or more lands which are configured so as to be substantially parallel to the turbine casing. Each such land may thus form a respective elongate convex-sectioned ridge extending between the carrier front and rear ends. Accordingly, in such embodiments those one or more lands may thus constitute the respective one or more portions of the carrier wall which have formed therein the one or a plurality of impingement apertures for feeding air into impingement onto the turbine casing.

If desired or necessary, such one or more elongate apertured ridge lands may have one or more flattened peak regions, in order to provide one or more zones of sufficient area to facilitate the provision in each thereof of a desired number, e.g. one or a plurality of, impingement apertures in a suitably configured array.

Embodiments of the invention such as those referred to above which include a carrier wall having an undulating circumferential profile, in which the carrier wall having the one or more portions provided with the impingement aperture(s) therein defines a cooling chamber located radially inwardly thereof, may in some cases be somewhat less preferred, especially when a common air feed source is used to supply air for the dual purposes of supplying the impingement apertures for onward impingement onto the casing and also for any additional cooling purpose into the aforementioned cooling chamber radially inwardly of the carrier wall. This is because the airflow for the former purpose may be expected to divert, disrupt or compromise the airflow for the latter purpose, leading to reduced efficacy in either or both airflows for their respective intended purposes.

Accordingly, in other embodiments of the invention the carrier wall having the one or more portions provided with the impingement aperture(s) therein may be a radially outer one of a pair of carrier walls, each carrier wall extending between front and rear carrier ends, wherein the pair of carrier walls define therebetween one or more chambers, e.g. one or more heating or cooling chambers, especially a cooling chamber, for receiving therein air, e.g. heating or cooling air, especially cooling air, from a feed source via said front end.

Conveniently both the first and second carrier walls may be integrally formed with the remaining structural elements of the carrier segment during a preferred casting method used to make it.

If desired or necessary the one or more chambers defined between the pair of carrier walls may include a dedicated holding chamber for supplying heating air from a respective feed source thereof to at least the impingement apertures in the radially outer carrier wall and onward into impingement onto the turbine casing. Alternatively or additionally the dedicated holding chamber may supply cooling air to a cooling chamber located between the pair of carrier walls. Such a dedicated holding chamber may for example be formed during the casting of the carrier segment by use of an appropriate additional core member, in accordance with well-established practices.

In some such embodiments the radially outer carrier wall having the one or more portions provided with the impingement aperture(s) therein may be generally substantially planar or flat, it being understood that this definition includes the provision of a small amount of curvature in the general plane of the radially outer wall in a circumferential direction, to take account of the annular nature of the overall carrier section or ring of which the carrier segment is to form a part.

In some such embodiments the radially outer carrier wall having the one or more portions provided with the impingement aperture(s) therein may comprise one or more extension sections extending axially (relative to the engine's longitudinal axis), e.g. in at least an axially forward direction, from a main carrier wall section via which the radially outer carrier wall is united with the remainder of the carrier segment. The or each axial extension section may be provided with impingement aperture(s) therein, in addition to the main section. This employment of one or more axial extension sections also containing impingement apertures for supply impinging air onto the turbine casing may be useful for providing an enhanced surface area over which such impingement of air onto the casing takes place, thereby possibly leading to enhanced heating rates and/or responsiveness of the casing to required temperature changes. It may furthermore usefully enable the position of any offtake or exhaust holes (as discussed further below) to be moved away from the zone of the engine containing the turbine blades and radially outward of the blade track.

If desired or necessary the one or more extension sections may be supplied with air from a feed source which is a different feed source from that which supplies the air to the main section of the carrier wall, although in some preferred embodiments it may be more convenient that the same feed source, optionally by utilisation of one or more modified air feed routes, e.g. one or more extra conduits or through-holes in particular appropriate structural elements within the engine architecture, is used for supplying air to both the main and the one or more extension sections. In this manner both the main and the one or more extension sections may thus be supplied with air at substantially the same predetermined temperature, so that a uniform level of heat transfer onto the casing is effected over substantially the whole combined areas of the main and extension carrier wall sections.

In such embodiments in which the radially outer carrier wall comprises one or more extension sections, in order to facilitate the impingement of air onto the radially inner wall of the casing and the post-impingement passage of that air over substantially the full axial extent of the carrier wall portions before exiting the region of the carrier section of the engine adjacent the casing (which is discussed further hereinbelow), any support or mounting rail or hook via which the carrier segment is supported or mounted in the engine may include one or more cut-out sections or apertures therein. This is in order to provide a route via which air having already exited the impingement apertures in the carrier wall sections and into impingement on the casing can traverse the space between the carrier wall and the casing before being exhausted therefrom.

In practical embodiments of the invention the overall flow of air of the predetermined temperature from the feed source into impingement onto the casing via the impingement apertures in the carrier wall may be controlled or regulated by a control device including at least one valve. The at least one valve may be located in a potential airflow path between the carrier segment and the casing, i.e. radially outwardly of the carrier segment and radially inwardly of the casing, optionally axially forward of the carrier section of the engine in which the carrier segment is mounted. Selective actuation of the at least one valve by the control device, e.g. the device being part of the engine's overall management or operating system, may thus open or close, as the case may be, an exhaust route for the air after it has impinged upon the casing, that exhaust route being toward an outboard side of the engine.

In this manner the selective actuation of the at least one valve may serve as a "switch" to allow or prevent, as the case may be, a flow of air of the predetermined temperature from the feed source to flow through the impingement apertures and onto the casing to effect its heat-transfer (in preferred embodiments) thereto. Thus, the control device may be configured to selectively actuate the at least one valve only when such heating of the casing is required, e.g. upon beginning, or during, a transient operating condition or stage of an overall flight profile in which the engine is run at increased power.

When the at least one valve is closed, the corresponding airflow from the feed source through the impingement apertures and onto the casing may thus be at least partially closed. However even in this configuration in some embodiments (especially those in which a pair of carrier walls, including the radially outermost one having the impingement apertures therein, are provided and define therebetween one or more chambers, e.g. a cooling chamber) it may be advantageous to maintain at least a partial airflow path from the space radially outward of the impingement apertured carrier wall and radially inward of the casing and into a said cooling (or other) chamber. Such a maintained airflow path may usefully be provided via one or more holes or conduits in an axially rearmost end of the carrier segment.

However, it is to be understood that, if desired or necessary, it is possible within the scope of the preceding embodiments for a partial or minor level of airflow from the feed source through the impingement apertures and onto the casing may be maintained at e.g. substantially all times, even outside such transient enhanced-power engine operating conditions, in order to help optimise the thermal responsiveness of the system and the reduction of unnecessarily large turbine tip clearances in any given stage of an overall flight profile. This may for example be useful particularly in the case of shroudless turbine blades.

In embodiments in which the overall airflow from the feed source into impingement onto the casing is controlled by the at least one valve under control of the control device, the overall speed of the air as it flows along the flowpath may be selected or adjusted to provide an optimum flow rate. This may for example be by simple regulation of the at least one valve. However, an optimum flow rate, e.g. when the at least one valve is open, may further be defined or selected by appropriately selecting a ratio of the total cross-sectional area of all the impingement apertures in the flow path to the area of restriction of the at least one valve. Such optimisation of the overall airflow may thus be used to optimise the strength of heating (in preferred embodiments) of the casing upon impingement of the air of predetermined temperature thereupon.

A method of controlling the temperature of a turbine casing of a gas turbine engine, the engine including an array of circumferentially spaced turbine blades disposed radially inwardly of the casing and circumscribed by a carrier section comprising a plurality of carrier segments according to the first aspect of the invention or any embodiment thereof, and wherein the carrier segments are arranged radially inwardly of the turbine casing and radially outwardly of the turbine blades, with the said one or more portions of their respective carrier walls facing the turbine casing, may comprise: passing air of a predetermined temperature from a feed source through the impingement apertures in the one or more portions of the carrier wall of the or each carrier segment and into impingement on the casing, so that the temperature of the casing is controlled in dependence on the predetermined temperature of the impinging airflow thereon, and exhausting the air, once it has impinged onto the casing, from a space between the carrier segment and the casing.

The step of exhausting the air from the space between the carrier segment and the casing may comprise exhausting it at least partially to an outboard side of the engine. Alternatively or additionally, the exhausting step may comprise exhausting the air at least partially from the said space between the carrier segment and the casing, optionally via an axially rearmost end of the carrier segment, and into a chamber, especially a cooling chamber, defined radially inwardly of a second carrier wall located radially inwardly of the carrier wall containing the impingement apertures.

A method of operating a gas turbine engine may comprise: running the engine under at least one transient operating condition of increased power, during said at least one transient operating condition feeding air of a predetermined temperature from a feed source through the impingement apertures in the one or more portions of the carrier wall of the or each carrier segment and into impingement on the turbine casing, so as to control the temperature of the casing in dependence on the predetermined temperature of the impinging airflow thereon, and exhausting the air, once it has impinged onto the casing, from a space between the carrier segment and the casing.

The step of exhausting the air from the space between the carrier segment and the casing may comprise exhausting it at least partially to an outboard side of the engine. Alternatively or additionally, the exhausting step may comprise exhausting the air at least partially from the said space between the carrier segment and the casing, optionally via an axially rearmost end of the carrier segment, and into a chamber, especially a cooling chamber, defined radially inwardly of a second carrier wall located radially inwardly of the carrier wall containing the impingement apertures.

Within the scope of this application it is expressly envisaged that the various aspects, embodiments, examples and alternatives, and in particular the individual features thereof, set out in the preceding paragraphs, in the claims and/or in the following description and drawings, may be taken independently or in any combination. For example, features defined or described in connection with one embodiment are applicable to any and all embodiments, unless expressly stated otherwise or such features are incompatible.

BRIEF DESCRIPTION OF THE DRAWINGS

Embodiments of the invention will now be described in detail, by way of example only, with reference to the accompanying drawings, in which:

FIG. 3(*b*) is a perspective view of the carrier segment alone of the arrangement of FIG. 3(*a*);

FIG. 3(*c*) is a schematic side view of an alternative profile of the carrier wall of the carrier segment of FIG. 3(*b*);

DETAILED DESCRIPTION OF EMBODIMENTS OF THE INVENTION

Figure 1:
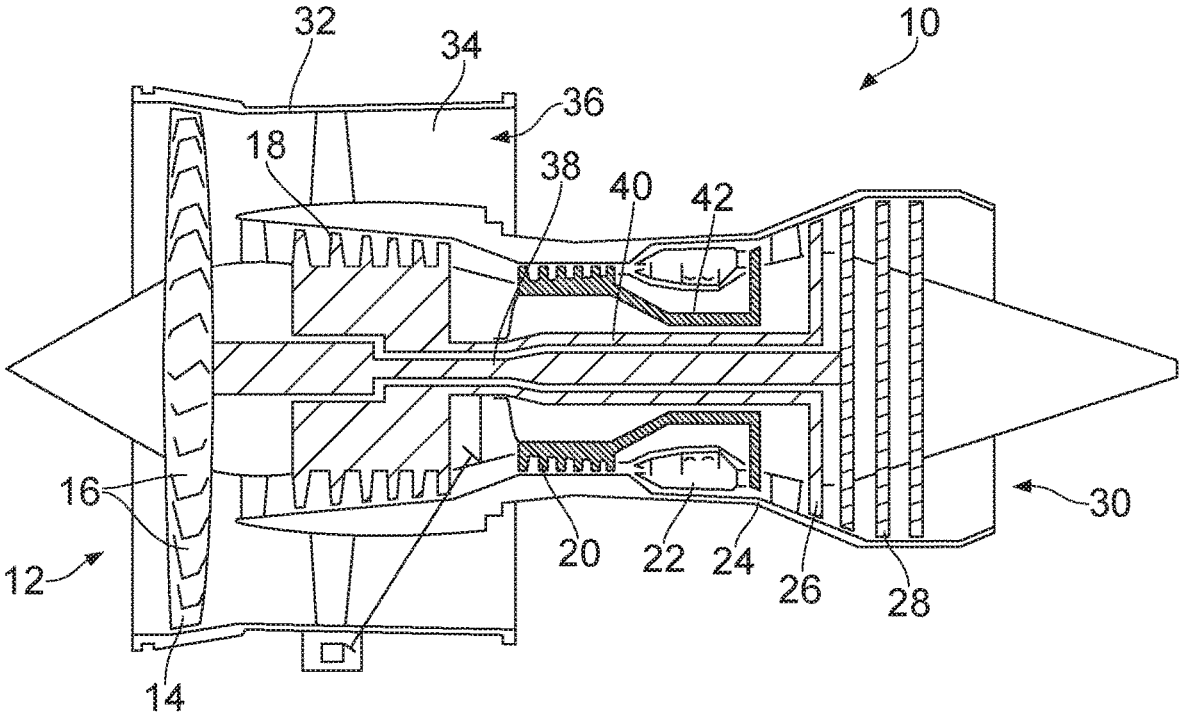
FIG. 1 is a schematic cross-sectional representation of a known aircraft ducted fan gas turbine engine, illustrating its main component sections, and has already been described.
Figure 2:
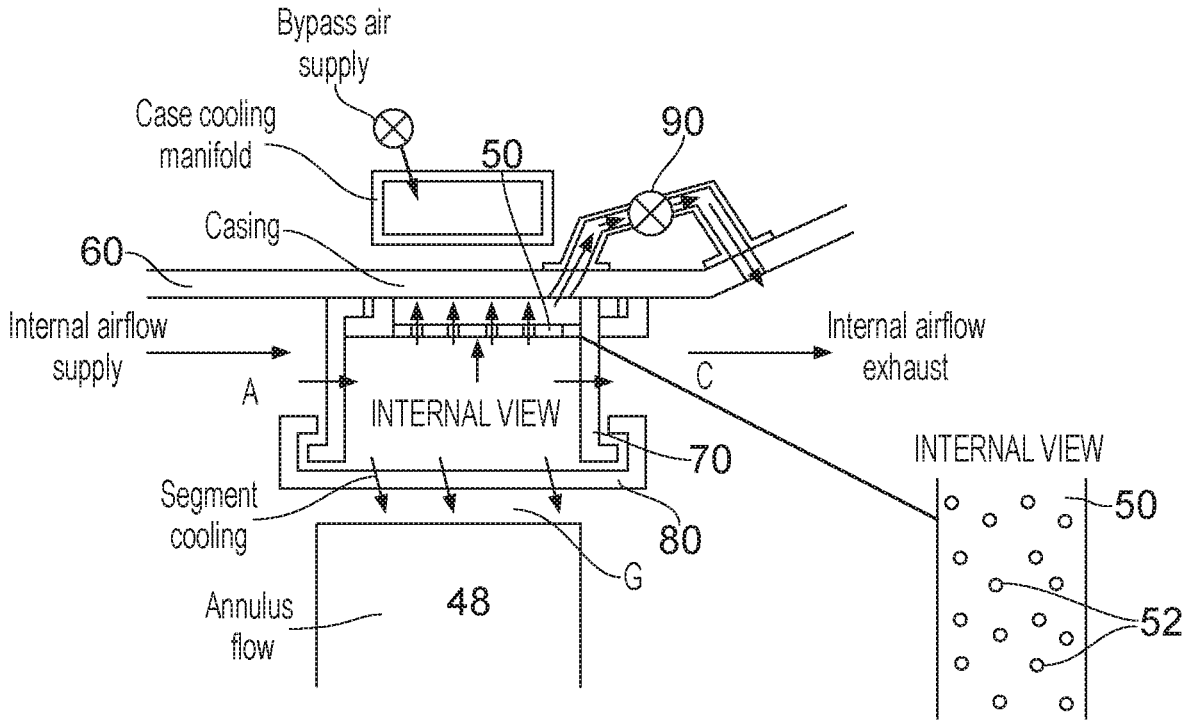
FIG. 2 (Prior Art)
FIG. 2 is a schematic sectional view of a known system, as disclosed in EP2372105A, for actively controlling the temperature of the turbine casing of an engine to a desired degree, so that its radial expansion can be more accurately matched in a responsive manner to that of the turbine disc/blades, e.g. in the event of a transient period of increased engine power such as a step climb.
Figure 3A:
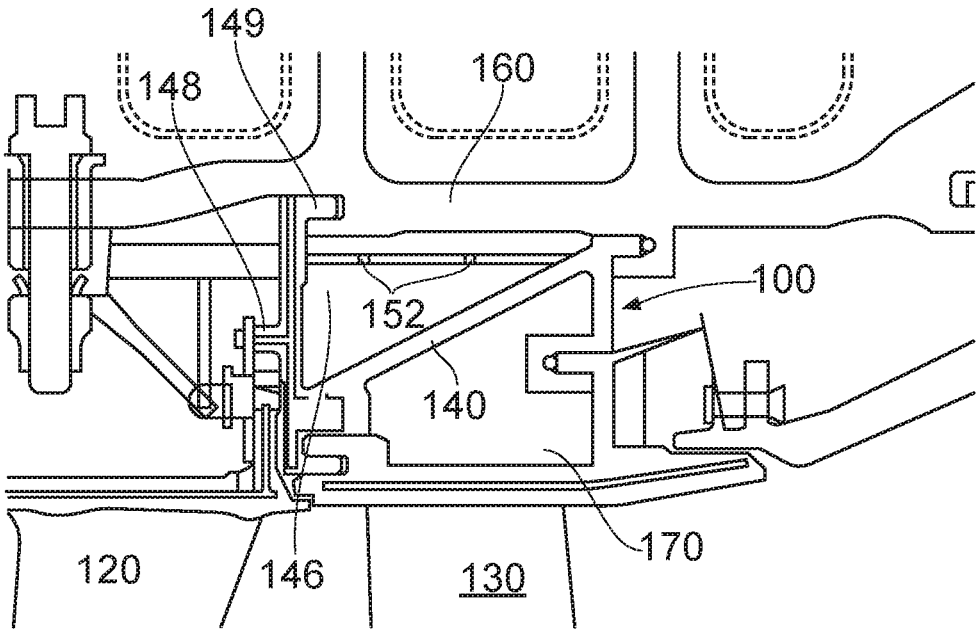
FIG. 3(*a*) is a cross-sectional view of an arrangement according to a first embodiment of the invention.
Figure 3B:
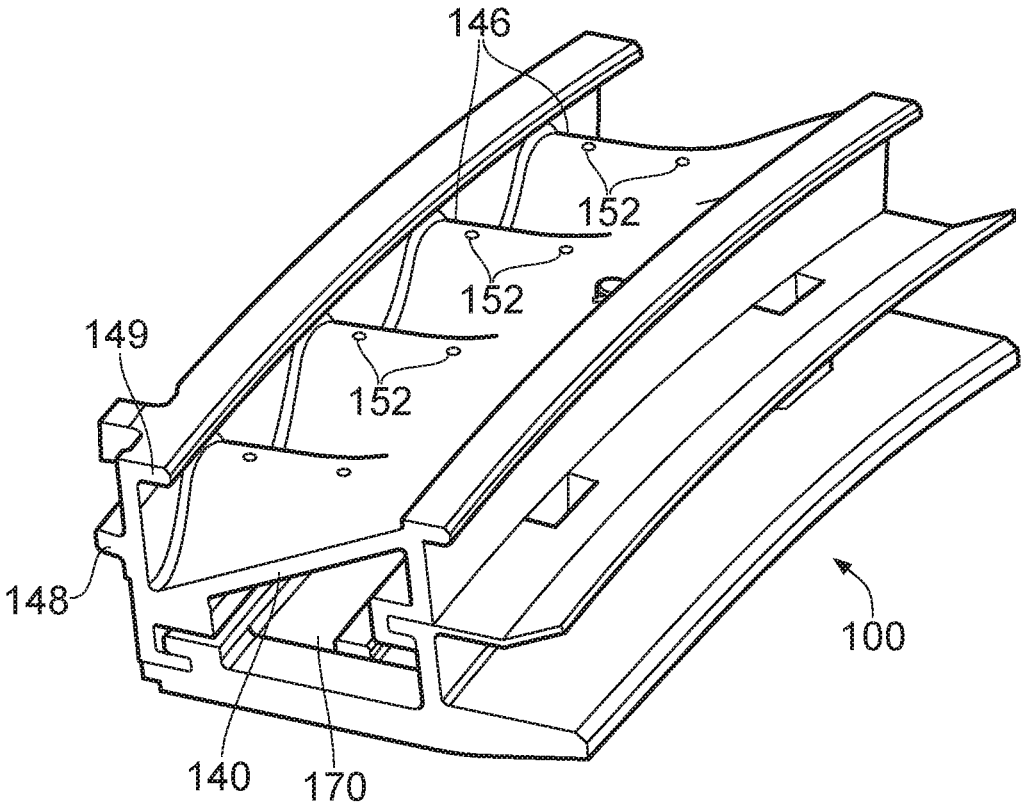
Figure 3C:
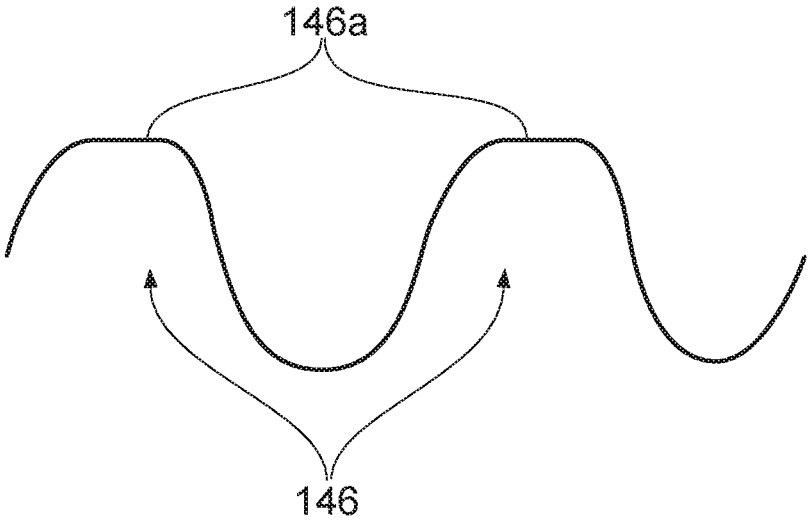

Referring firstly to FIGS. 3(*a*) and 3(*b*) (FIGS. 1 and 2 having already been described in the context of the prior art), here there is shown a first embodiment of the system of the invention, as applied to a HP section of a gas turbine engine, which may be any type of gas turbine engine. In the illustrated arrangement the engine casing 160 and carrier segment 100 are located generally radially outwardly of turbine blades (shown merely schematically as) 130 and HP nozzle guide vanes (NGV's) 120. Also shown are flap seal 148, and a mounting hook or rail 149. The latter has been moved into a relatively more radially outboard location in comparison with many known arrangements, in order to allow an integrally formed undulating carrier wall 140, comprising a series of equi-spaced sinusoidal (or other wave function) corrugations 146, to be accommodated so that the elongate axially oriented peak regions or lands of each corrugation 146 are positioned at a generally uniform and equal spacing from the radially inner wall of the casing 160. It also enables the manner of location and mounting of the NGV's 120, the HP carrier segments 100 themselves and the anti-rotation device(s) 148 to remain the same as in known arrangements. The undulating corrugations 146 are used to allow air to be fed through the front end of the carrier segment 100 (such as via one or more conduits (not shown)) into a cooling chamber located radially inwardly of (i.e. below, in the Figure) the carrier wall 140, and also to provide the carrier wall 140 with a suitable degree of strength and stiffness so as to enable it to withstand typically high mechanical and/or thermal loads placed upon it during operation of the engine. The carrier wall 140 is formed integrally with the other wall structures of the carrier segment 100, e.g. in the overall casting or other method used to manufacture it.

Formed in the peak regions or lands of each corrugation 146 are an array or series of circular impingement apertures or through-holes 152, which are oriented with their respective longitudinal axes normal (i.e. perpendicular) to the radially inner surface of the casing 160. The apertures 152 may conveniently be drilled or machined in the carrier wall 140 in a post-casting step.

The size and spacing of the impingement apertures 152, as well as the distance from their exits to the radially inner wall of the casing 160 (which may be selected by adjusting the radial positioning of the locator hooks 149 during the casting thereof), may be varied from the example arrangement shown, depending on the precise practical requirements of the arrangement. For example, more than two such impingement apertures per ridge region may be provided. In addition, the apertures 152 may, if desired or necessary, be located at a different, e.g. a radially more inboard, location on the corrugations 146, depending on the exact thermal requirements of the system.

For allowing the casing 160 to be heated during a transient period of enhanced engine power such as a step climb, the air from a feed source flows from an outboard side of the carrier wall 140 and through the impingement apertures 152 into impingement on or against the radially inner wall of the casing 160. As the hot air thus contacts and flows over the radially inner surface(s) of the casing 160, the latter is heated rapidly so that its resulting radial expansion more responsively matches the radial expansion of the turbine blades 130 as they too heat up under the same conditions of enhanced engine power. As a result, the turbine blade tip clearance distance can be maintained at an optimum value, without increasing or decreasing by an unnecessarily great distance which could have serious deleterious consequences for the engine if not overcompensated for, as is necessarily the case with known prior art arrangements.

The strength of the heating effect on the casing 160 may also depend on the speed of the air flow through the impingement apertures 152, which may in practice be adjusted for example by altering the ratio of the total aperture cross-sectional area to the cross-sectional area of restriction in a valve used to switch on or off the impinging airflow (as described below in the context of another illustrative embodiment).

FIG. 3(*c*) is a schematic side view of an alternative profile of the carrier wall of the arrangement of FIGS. 3(*a*) and 3(*b*). As shown very simply here, the undulating form of the carrier wall 140 is illustrated as being approximately sinusoidal. However, this shape can usefully be modified slightly by flattening the peak regions 146*a* of the corrugations 146 facing and nearest to the casing 160, for example in order to accommodate in each peak region zone 146*a* a greater number of impingement apertures, e.g. however many may be most appropriate for any given example impinging airflow arrangement with specific desired thermal heat transfer characteristics.

Figure 4:
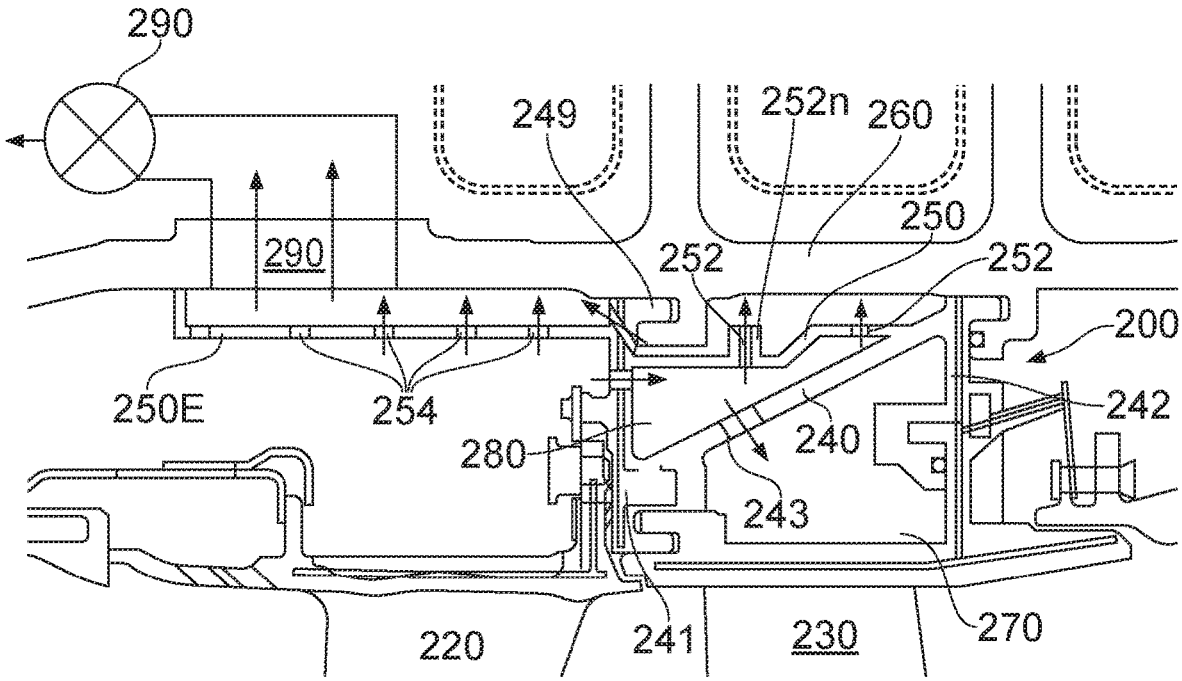
FIG. 4 is a cross-sectional view of an arrangement according to a second embodiment of the invention.

FIG. 4 is a cross-sectional view of an arrangement according to a second embodiment of the invention. Features which correspond to those of the first embodiment of FIG. 3 are shown here using corresponding reference numerals but incremented by 100. As shown in this embodiment, here the integral carrier wall 240, which extends between radially extending upstream 241 and downstream 242 carrier walls is oriented at an inclined angle with respect to the engine axis. A radially outer or impingement carrier wall 250 is located radially inwards and opposite the casing and has formed therein the array of impingement apertures 252 for delivery of an impinging flow heating air therethrough and onto the casing 260 in a corresponding manner as in the first embodiment of FIG. 3. Here, however, the general airflows are shown by arrows (→).

By way of optional example, FIG. 4 shows one of the impingement apertures 252 being formed within a radially outwardly protruding noggin or spigot 252*n*, which may, if desired or appropriate, be used to locally reduce the impingement distance of travel of the impinging air between its exit from that aperture 252 and the relevant portion of the casing 260 against which it impinges, e.g. for maintaining an optimum z-d ratio (impingement distance/hole diameter) for that aperture 252.

The radially outer, impingement-apertured, carrier wall 250 defines between it and the radially inner carrier wall 240 an intermediate heating or holding chamber 280, for optimising the supply of a required volume, pressure and temperature of heating air to the impingement apertures 252. As shown by way of example only, if desired or if necessary depending on the thermal requirements of the system, the inner carrier wall 240 may itself be provided with one or more through-holes 243 for passage therethrough of a desired volume of air from the common feed source, for the purpose of feeding cooling chamber 270 defined radially inwardly of (i.e. beneath, in the Figure) the inner carrier wall 240.

Also shown in FIG. 4 is a variant of the basic design of apertured carrier wall 250 in which axially forward of the main carrier wall 250 extends an extension section 250E which likewise is formed with an array of impingement manifold apertures 254 therein, the latter array of apertures 254 being for transmitting heating air to portions of the casing 260 axially forward of the main casing section bounded by the main body of the carrier segment 200. This carrier wall extension section 250E may thus serve to enhance the overall thermal behaviour of the casing 260 as it is heated by the various impinging hot air jets (→), by providing a greater axial extent of heating and enabling a faster casing response to an elevation in its temperature as hot compressor air impinges upon it.

Radially inboard of the carrier is located a seal segment which bounds the main gas path of the engine. The seal segment attaches to the engine casing via the carrier and respective bird-mouth attachments. The seal segment includes internal cooling passages which extend radially inboard of the gas facing wall and provide a suitable distribution of cooling air as known in the art. The cooling air exhausts for apertures located in side faces or the trailing edge of the seal segment.

The overall airflow in the embodiment of FIG. 4 is controlled so between two flow paths in normal use. The two flow paths are used in varying proportions as dependent on the operating condition of the engine and are principally controlled by the operation of an exhaust valve 290 of an outboard exhaust system which forms part of the arrangement. The valve 290 may be controlled by the engine's overall management or operating system, and may thus actuate the valve to control the airflow through the arrangement in dependence on whether or not a steady state or cruise condition, or a transient phase of increased engine power, e.g. a step climb, is initiated or in progress and where an increased reaction time is required from the engine casing to avoid a blade 230 rub with the seal segment.

The first flow path provides a flow of air against the casing 260 prior to it passing radially inboard and through the seal segment cooling system and respective exhaust apertures. The second flow path is against the casing and out of the engine casing via the exhaust valve 260 in the casing. When the exhaust valve 290 is open, the dominant flow of air is against the casing and forward of the upstream carrier wall. When the exhaust is closed, the dominant flow is axially rearwards and inboard, exhausting through the seal segment exhausts. The flow paths and modes of operation are described in more detail below with regard to FIGS. 6 and 7.

Figure 5:
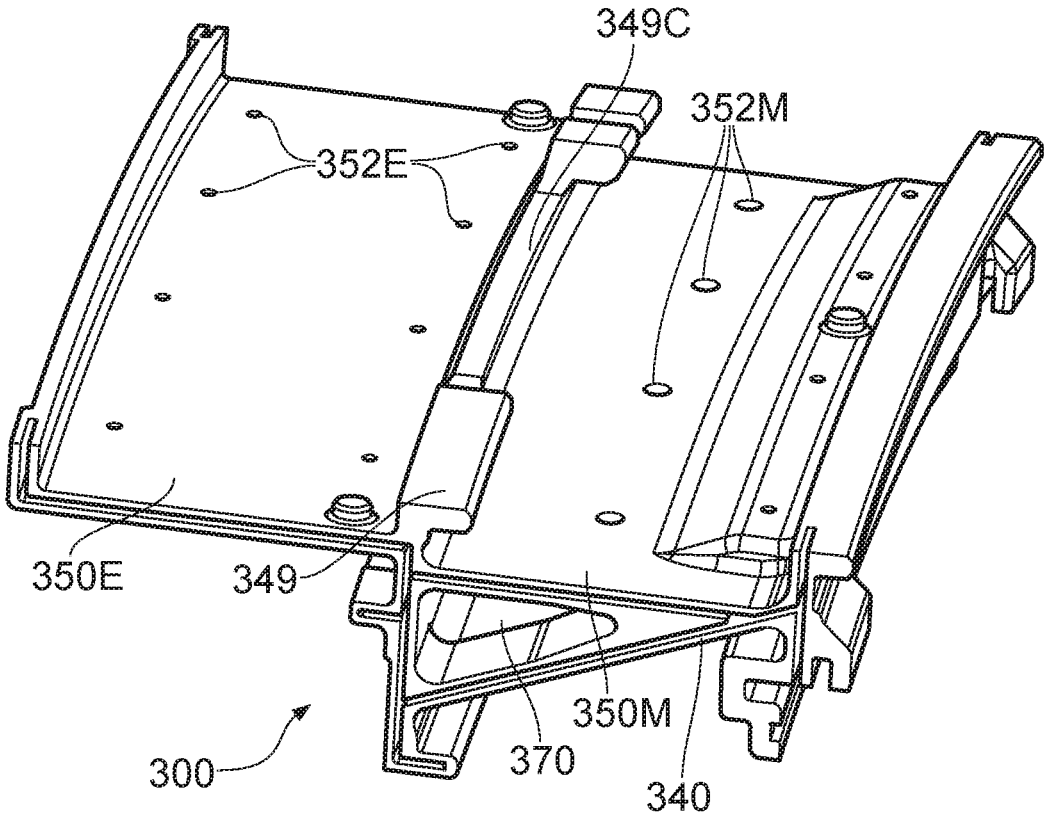
FIG. 5 is a perspective view of a carrier segment of an arrangement according to a third embodiment of the invention.

FIG. 5 is a perspective view of a carrier segment 300 of an arrangement according to a third embodiment of the invention. Features which correspond to those of the first embodiment of FIG. 3 are shown here using corresponding reference numerals but incremented by 200. This embodiment is very similar in form and function to that of FIG. 4, as will be readily apparent from the foregoing description. Here the apertured carrier wall comprises a main carrier wall section 350M and an axially forward extension section 350E, each having a respective array of impingement apertures 352M, 352E formed therein. As shown in the Figure by way of example, each respective array of impingement apertures 352M, 352E may if desired or appropriate be different from one another, such as in terms of number, area density and/or size of the respective apertures. Also as shown in FIG. 5, the support or mounting rail or hook 349 via which the carrier segment 300 is supported/mounted in the engine includes one or more cut-out sections 349C, in order to provide a route via which air having already exited the impingement apertures 352M, 352E in the carrier wall sections 350M, 352E and into impingement on the casing 360 can traverse the space between the carrier wall 350 and the casing 360 before being exhausted therefrom.

Using shroudless turbine blades may increase the need for a more thermally responsive and matched system, i.e. blade growth/shrinkage is desirably as close as possible to (i.e. follows) that of the casing in order to maintain the closest possible optimum tip clearance gap.

Figure 6:
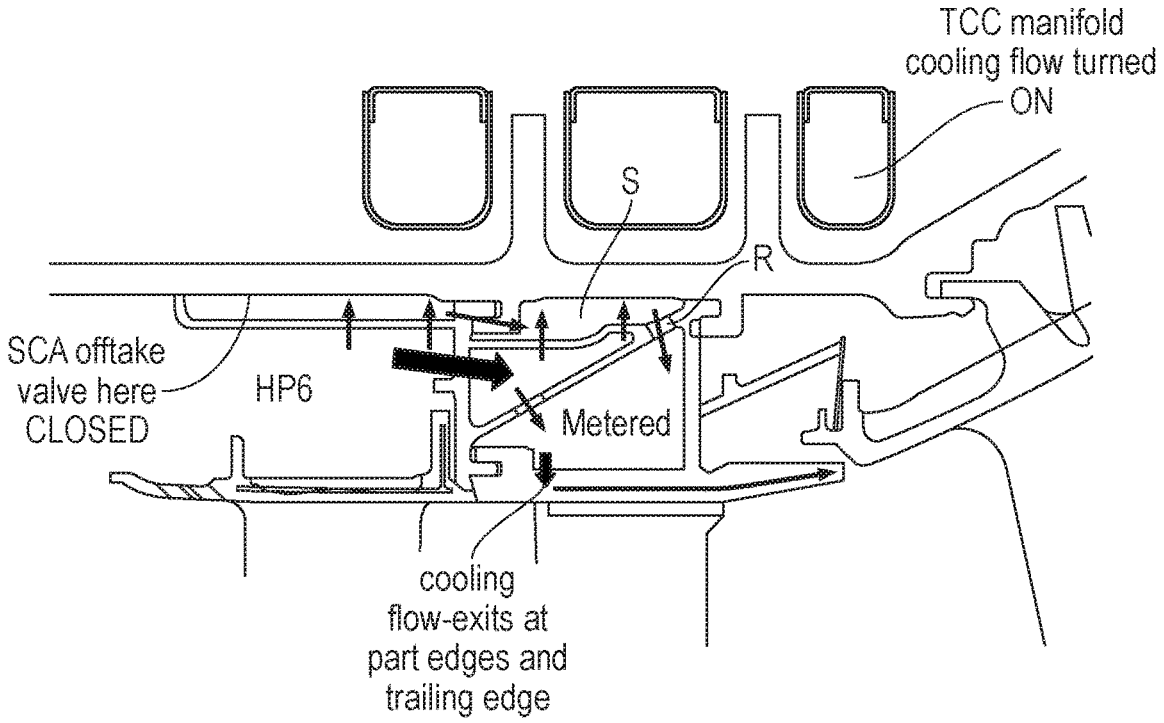
FIG. 6 is an explanatory view of typical air flow paths as found in any of the arrangements shown in any of FIGS. 4, and 5 under conditions of normal cruise operation of the engine, without activation of the system of air impingement onto the casing in accordance with the invention.

FIG. 6 provides an explanatory view, annotated, of typical air flow paths as found in any of the arrangements shown in any of FIGS. 4 and 5 under a first mode of operation in which the exhaust valve is substantially closed. This mode of operation corresponds to conditions of normal cruise operation of the engine, where a proportion of heating air impinges on the engine casing before being exhausted into the main gas path. This mode of operation provides a constant light level of impingement air from an appropriate stage of the compressor onto the inner wall of the casing to provide the engine casing with a predetermined level of heating. This heating may be provided throughout substantially the whole period of engine operation during generally the whole of a given flight profile/cycle but may be used selectively where required.

Hence, in the first mode of operation, compressor air impinges onto the casing wall prior to being travelling inboard towards the seal segment. The cooling air then passes through metering holes towards the downstream radial carrier wall and radially inboard via a suitable aperture. A further metering hole is provided in the main angled carrier wall so that at least of portion of the cooling air passes directly towards the seal segment and the cooling system therein before being exhausted into the main gas path as described above.

In addition the exhausting of some compressor air at least partially from the space between the carrier segment and the casing may optionally be via an axially rearmost end of the carrier segment, as indicated by airflow arrow labelled R, and into the cooling chamber beneath (i.e. radially inwardly of) the inclined radially inner carrier wall.

Figure 7:
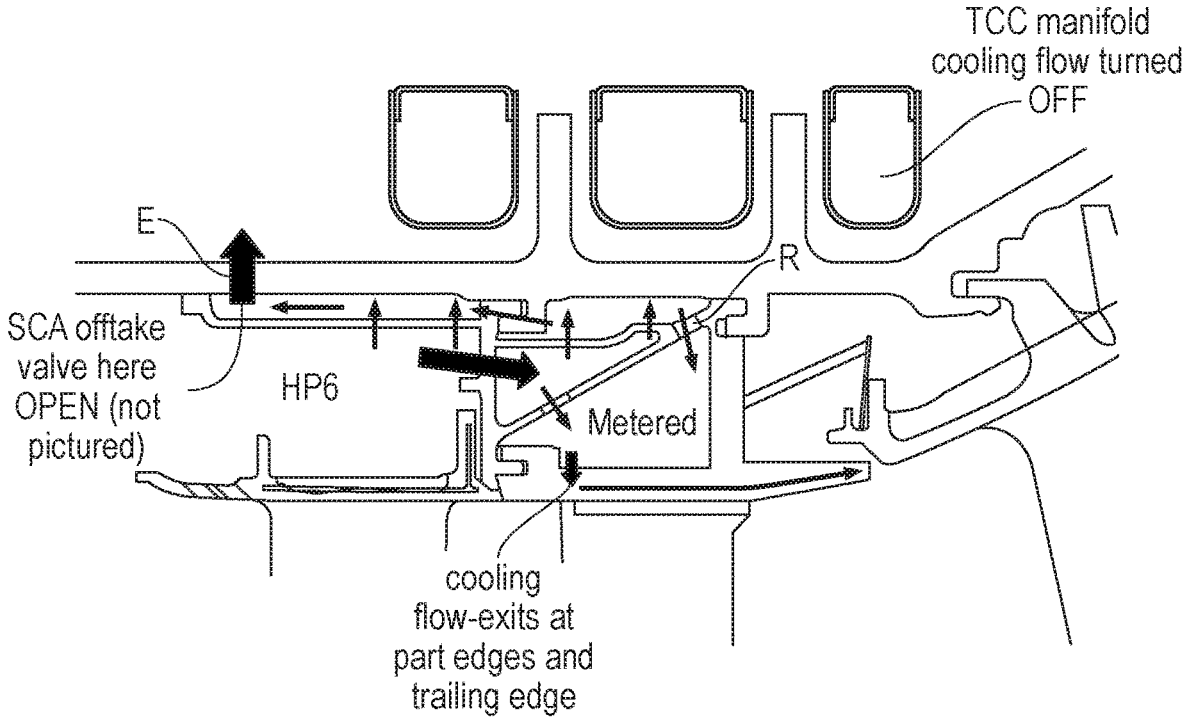
FIG. 7 corresponds to FIG. 6, being an explanatory view of typical air flow paths as found in any of the arrangements shown in any of FIGS. 4 and 5, but under a condition of transient increased engine power, such a step climb, with activation of the system of air impingement onto the casing in accordance with the invention.

FIG. 7 corresponds to FIG. 6, being an explanatory view, again annotated, of typical air flow paths as found in any of the arrangements shown in any of FIGS. 4 and 5, but under a second mode of operation which corresponds to a condition of transient increased engine power, such as a step climb, with activation of the system of air impingement onto the casing in accordance with the invention. In this case, the exhaust valve control system E is open, allowing the airflow as indicated by the various arrows. With the air impingement system in operation as shown, some air may still flow rearwards and feed the carrier segment cooling chamber below (i.e. radially inwardly of) the inclined radially inner carrier wall, though more flow is taken overall and most will flow forwards and out through the outboard offtakes in the casing.

In the illustrated arrangement of FIGS. 6 and 7, air feed through the forward casing hook that is used to mount the carrier segment may desirably be as free and uninterrupted as possible, as also is the air feed radially inboard of this through the front rail of the carrier segment, so that there is as little pressure drop across these two thresholds as possible. This may further optimise the system so as to give even quicker thermal reaction times, leading to an even more thermally responsive system throughout a given flight profile/cycle.

It is to be understood that the above description of embodiments and aspects of the invention has been by way of non-limiting examples only, and various modifications may be made from what has been specifically described and illustrated whilst remaining within the scope of the invention as defined in the appended claims.

Throughout the description and claims of this specification, the words "comprise" and "contain" and variations of the words, for example "comprising" and "comprises", mean "including but not limited to", and are not intended to (and do not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Furthermore, features, integers, components, elements, characteristics or properties described in conjunction with a particular aspect, embodiment or example of the invention are to be understood to be applicable to any other aspect, embodiment or example described herein, unless incompatible therewith.

The invention claimed is:

1. An arrangement for a gas turbine engine comprising:

a. a turbine blade configured to rotate about an axis;

b. a casing radially outside the turbine blade;

c. a carrier segment mounted to the casing so as to define a first impingement space therebetween, the carrier segment being positioned radially outside the turbine blade and comprising:

i. a first impingement carrier wall adjacent to and radially inside of the first impingement space, the first impingement carrier wall including a first aperture;

ii. a main carrier wall radially inside of the first impingement carrier wall;

iii. a cooling chamber radially inside of the main carrier wall;

iv. an intermediate chamber radially between the cooling chamber and the first impingement space;

v. a second aperture configured to allow ingress of air into the intermediate chamber, and wherein the first aperture of the first impingement carrier wall is configured to allow ingress of the air into the first impingement space; and vi. a third aperture configured to allow flow of the air from the first impingement space to the cooling chamber.

2. The arrangement of claim 1 wherein the intermediate chamber is tapered in an axial direction of the gas turbine engine.

3. The arrangement of claim 2 wherein the intermediate chamber is larger proximal to the second aperture than distal to the second aperture.

4. The arrangement of claim 1, wherein the third aperture is formed in an axially downstream end portion of the carrier segment.

5. The arrangement of claim 1, further comprising a second impingement space that is defined between the casing and a second impingement carrier wall spaced radially inwardly from the casing and axially adjacent to the first impingement carrier wall, the second impingement carrier wall comprising a plurality of impingement apertures configured to allow ingress of air into the second impingement space.

6. The arrangement of claim 5, further comprising a fourth aperture that allows air flow between the second impingement space and the first impingement space.

7. The arrangement of claim 1 further comprising a fifth aperture in the main carrier wall that is configured to allow air flow between the intermediate chamber and the cooling chamber.

8. A gas turbine engine comprising the arrangement of claim 1.

9. A method of controlling a temperature of a turbine casing of a gas turbine engine, the engine including:

a turbine blade configured to rotate about an axis;

a casing radially outside the turbine blade;

a carrier segment mounted to the casing so as to define a first impingement space therebetween, the carrier segment being positioned radially outside the turbine blade and including:

a first impingement carrier wall adjacent to and radially inside of the first impingement space, the first impingement carrier wall including a first aperture, a main carrier wall radially inside of the first impingement carrier wall;

a cooling chamber radially inside of the main carrier wall; and an intermediate chamber radially between the cooling chamber and the first impingement space;

the method comprising:

passing air from an air feed source to the intermediate chamber;

passing the air from the intermediate chamber, through the first aperture in the first impingement carrier wall, and into the first impingement space so that the air impinges on the casing; and passing the air from the first impingement space into the cooling chamber.

10. The method of claim 9, wherein a second aperture is disposed between the air feed source and the intermediate chamber, and the air passes through the second aperture to reach the intermediate chamber.

11. The method of claim 9, wherein a third aperture is disposed between the first impingement space and the cooling chamber such that the air passes directly from the first impingement space, through the third aperture, and into the cooling chamber.

12. The method of claim 9, further comprising passing air directly from the intermediate chamber to the cooling chamber.

* * * * *